US005816485A

United States Patent [19]

Bernstein

[11] Patent Number: 5,816,485

[45] Date of Patent: Oct. 6, 1998

[54] DOUBLE ANGLE CLAMSHELL CONTAINER

[75] Inventor: Linda A. Bernstein, Maineville, Ohio

[73] Assignee: International Paper Co., Purchase, N.Y.

[21] Appl. No.: 838,814

[22] Filed: Apr. 10, 1997

[51] Int. Cl.[6] ..... B65P 5/20; B65P 5/42

[52] U.S. Cl. ..... 229/120; 229/110; 229/906

[58] Field of Search ..... 229/109, 110, 229/120, 146, 902, 903, 906

[56] References Cited

U.S. PATENT DOCUMENTS

| | | | |
|---|---|---|---|
| D. 264,792 | 6/1982 | Conti . | |
| D. 292,839 | 11/1987 | Brogdon . | |
| D. 329,806 | 9/1992 | Kindt . | |
| 2,048,205 | 7/1936 | Towell . | |
| 2,848,152 | 8/1958 | Geiger . | |
| 3,482,679 | 12/1969 | Bixler . | |
| 3,633,815 | 1/1972 | Rosenburg . | |
| 3,907,195 | 9/1975 | Struble | 229/120 |
| 4,232,816 | 11/1980 | Johnson . | |
| 4,304,329 | 12/1981 | Graser . | |
| 4,497,431 | 2/1985 | Fay | 229/120 |
| 4,586,648 | 5/1986 | Josefsson et al. | 229/146 |
| 4,678,095 | 7/1987 | Barnett . | |
| 5,037,026 | 8/1991 | Hanko . | |
| 5,188,284 | 2/1993 | Eisman . | |
| 5,226,587 | 7/1993 | Eisman . | |
| 5,249,736 | 10/1993 | Eisman . | |
| 5,263,634 | 11/1993 | Korine | 229/120 |
| 5,531,373 | 7/1996 | Eisman . | |

FOREIGN PATENT DOCUMENTS

| | | | |
|---|---|---|---|
| 1079240 | 6/1980 | Canada | 229/120 |
| 2669900 | 6/1992 | France | 229/902 |

*Primary Examiner*—Gary E. Elkins
*Attorney, Agent, or Firm*—Christopher Nicastri

[57] ABSTRACT

A dome shaped crown for a clamshell container is formed by two sets of sidewalls having different shapes. A narrow space is provided between adjacent pairs of sidewalls, the spaces permitting venting of warm, moist air due to the presence of a heated sandwich packaged in the container. The container is formed from a unitary blank of paperboard. In one embodiment, the crown is dome shaped and the lower tray is provided with straight walls. In the second embodiment, both the crown and the lower tray have sidewalls of different slopes. Any type of releasable latch between the two halves may be employed.

7 Claims, 5 Drawing Sheets

DOUBLE ANGLE CLAMSHELL CONTAINER

BACKGROUND OF THE INVENTION

This invention relates to containers and more particularly to clamshell-type containers fashioned from a unitary blank of paperboard. Such containers have enjoyed wide acceptance in the serving of fast foods, such as hamburgers and the like, and are particularly popular because of their ease of disposability, ease of mass production, and convenience in use. The container art is aware of a wide variety of constructions for such containers.

In many of these known constructions, the form of the clamshell container is different from that of the hamburger, the latter typically being round and having a domed crown or top bun. It is one of the most popular fast food items served. Typically, the purchaser is given a clamshell container which is of generally rectangular parallelepiped form and, upon opening it, encounters finds a round, domed sandwich. Further, a rectangular container does not generally fit into the hand for carrying as easily as a round container.

SUMMARY OF THE INVENTION

According to the practice of this invention, a paperboard clamshell container or carton is provided which has a dome shape on its upper half to thereby more closely conform to the dome (crown) shape of a typical hamburger sandwich. Further, the container of this invention is provided with aesthetically pleasing vent slots, or gaps to permit venting of the interior of the container to atmosphere, in turn to reduce sogginess of the sandwich if left in the container for an appreciable period of time. Two embodiments of the invention are disclosed. A first embodiment has a domed lid or crown having two sets of sidewalls each of a different slope, and by a lower tray having upwardly sloping sidewalls of a single slope and provided with a flat central bottom. The second embodiment has an upper lid or crown and a lower tray which are substantially identical, with each having double sloped sidewalls. Both the crown and tray of the latter carry venting slots. The lid or crown may be latched to the tray by any desired latching arrangement, the latter being unimportant for the practice of this invention.

DETAILED DESCRIPTION OF THE INVENTION

Figure 1:
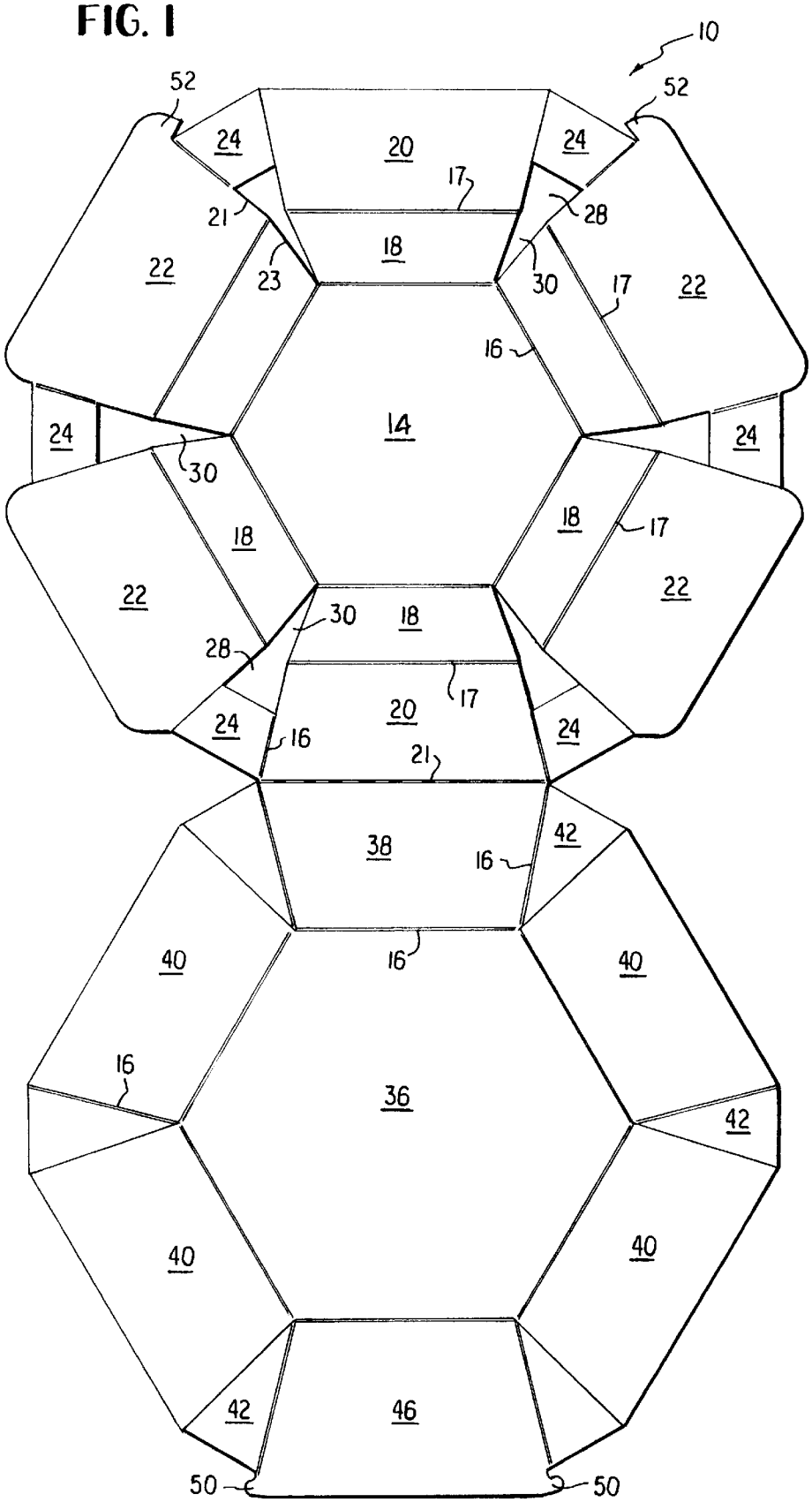
FIG. 1 is a plan view of a unitary blank of paperboard for forming the first embodiment of the invention.

Referring now to FIG. 1, a unitary blank 10 of (optionally) thermoplastic coated paperboard is provided with the indicated cut and fold lines. The blank includes an upper portion or half which will form the crown or upper part of the container, and a lower portion or half which will form the container tray. The upper portion includes a central panel 14, shown as a regular hexagon, whose periphery includes fold lines 16 along straight edges of the hexagon, and having sidewall panels 18 each joined at one edge to top panel 14 through these fold lines. Panels 20, 22 are also sidewall panels. Sidewall panel pairs 18, 20 and 18, 22 are joined by fold lines 17 between them. Radially outermost sidewall panels 20 and 22 carry glue tabs or ears 24 having fold lines (indicated by double lines) and terminating in the indicated free or cut ends. Tabs 24 are of a lesser radial extent than panels 20 and 22. Each of the upper two sidewalls 22 of FIG. 1 carries an extension 52, these extensions adapted to form a latch as will later be explained. Sidewalls 22 are of a greater radial extent, as referred to the center of top panel 14, than both panels 20 of the upper half and sidewall panels 38, 40, 46 of the lower half (soon to be described) to provide an overhang when the carton is closed. The radial extent of each panel 18 is the same. Circumferentially spaced gaps 28, located between adjacent pairs of sidewall pairs 18, 20 and 18, 22, provide vents in the completed carton, the radially innermost portions of gaps 28 denoted as 30. The longer edges of these gaps are denoted as 21 and 23. It is seen from FIG. 1 that each composite or whole sidewall of the crown includes two foldably connected panels or sections 18, 20 and 18, 22, separated by fold line 17. The sidewalls form a ring around center panel 14. Each gap 28, 30 resembles an isosceles triangle, but the two otherwise equal sides are not straight. Edges 23 of gap portions 30 and edges 21 of widest gap portions 28 are not collinear, rather are at a slight angle to each other. The reason for this deviation from collinearity is that the slope of any panel 18 is different from the slope of adjacent panels 20, 22, see FIG. 4, to be later described.

The lower half or tray portion of the container is integrally coupled to the upper or crown portion through a fold line 21. Lower sidewall panel 38 is immediately below and borders fold line 21. Circumferentially arranged tray sidewall panels 40 are coupled to the straight edges of central hexagonal bottom tray panel 36 by fold lines 16. Further, sidewall panels 38, 40, and 46 each foldably carry triangular glue tabs 42 coupled by the indicated fold lines to their respective sidewalls. Lowermost sidewall panel 46 is provided with ears 50 which cooperate with projections or ears 52 of upper crown panels 22 to form a releasable latching arrangement.

Figure 2:
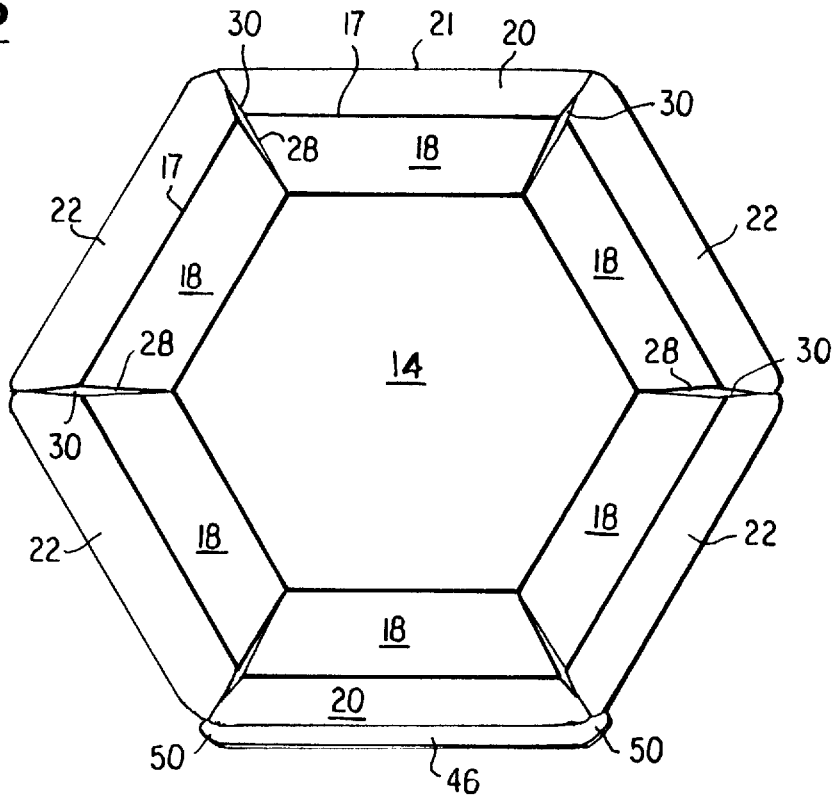
FIG. 2 is a top plan view of a clamshell container according to this invention according to the first embodiment.

Referring now to FIG. 2 of the drawings, the top plan view of the closed clamshell container shows the crown double slope upper sidewalls defined by panel pairs 18, 20 and 18, 22, with narrow vents 28, 30 between adjacent sidewalls. The lower portion of FIG. 2 shows latching ears 50 of the tray releasably holding the container in a closed position. An imaginary continuation of fold line 17 would intersect vent gaps 28 and 30.

Figure 3:
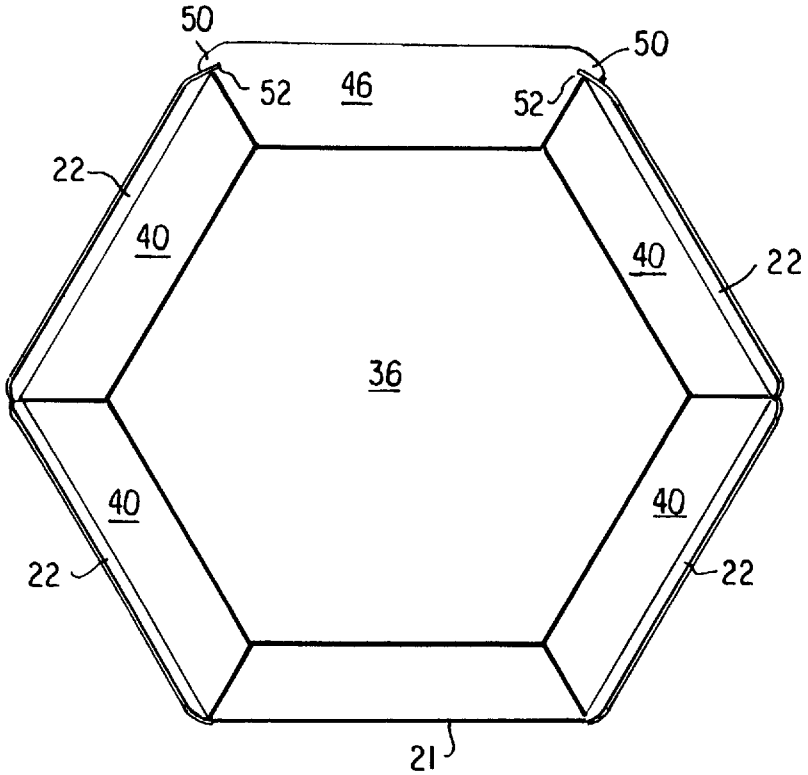
FIG. 3 is a bottom plan view of the first embodiment of this invention.

FIG. 3 is a bottom view of the closed clamshell container formed from the blank of FIG. 1.

Figure 4:
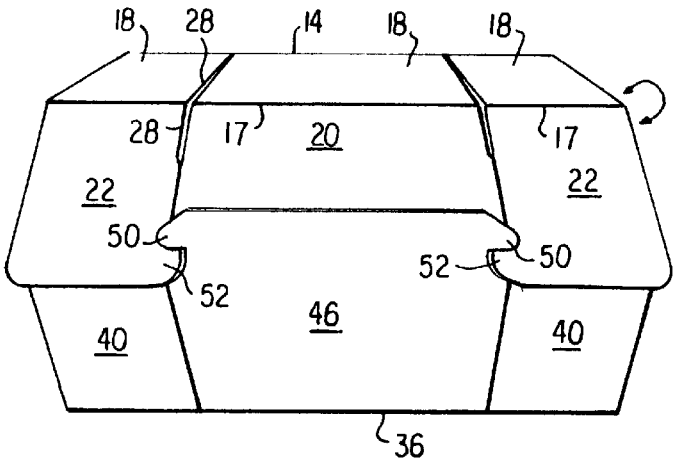
FIG. 4 is a front view of the first embodiment of this invention.

Referring now to FIG. 4, a side elevational view of the closed container formed from the blank of FIG. 1 is illustrated and again shows the top or crown portion whose sidewall pairs each has a double slope. Namely, there is an angle of approximately 140 degrees between lowermost crown sidewall panels 20, 22 and respective uppermost crown panels 18, as indicated by the curved, double headed arrow. The reader will understand that the specific releasable latching arrangement between ears 50 and 52 is merely illustrative of one several possible arrangements for latching the container in a closed configuration. Crown sidewalls 22 are of a greater slant length than tray sidewalls 40. The lower edges of sidewalls 22 extend below the upper edges of lower sidewalls 40.

Figure 5:
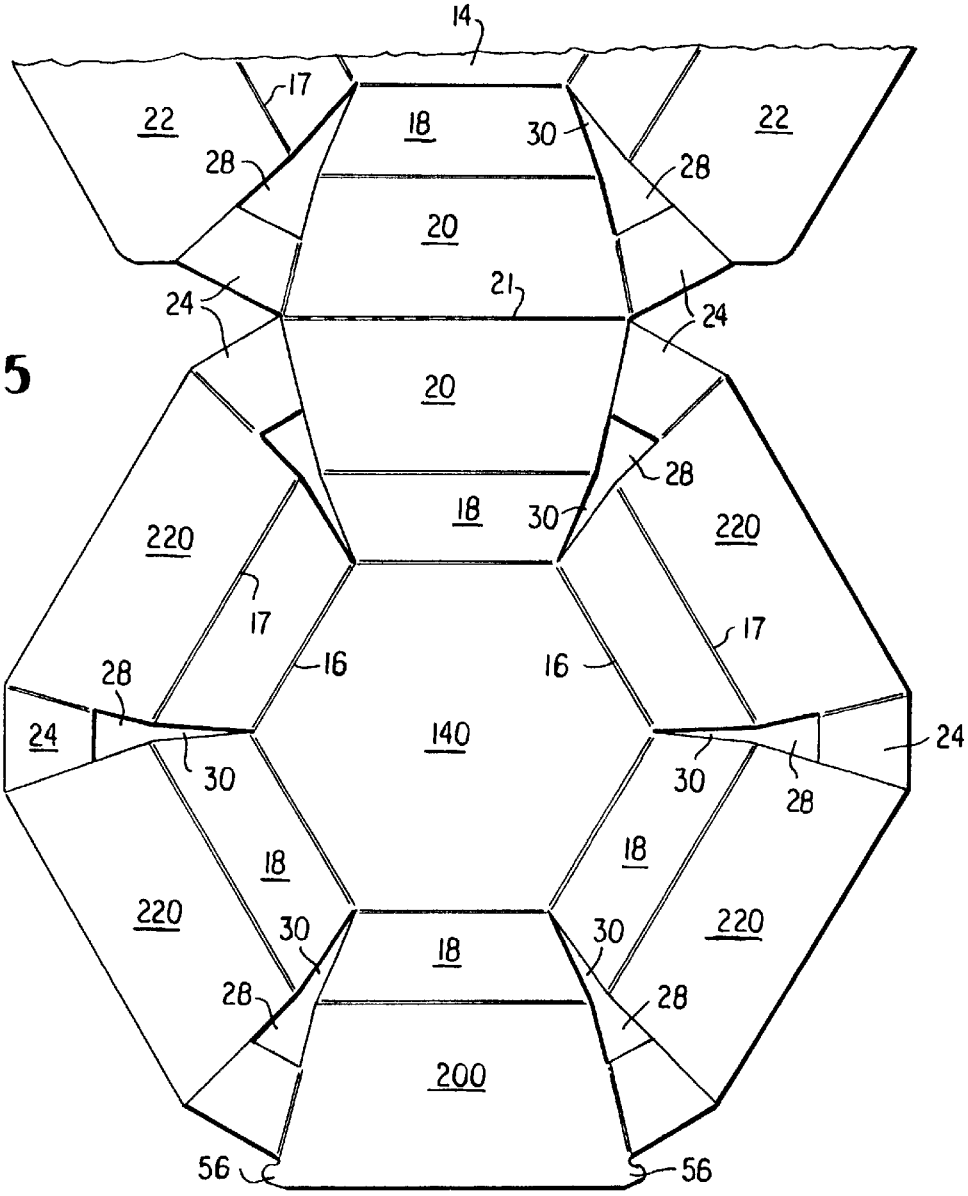
FIG. 5 is a plan view of a portion of a blank for forming a second embodiment of this invention.
Figure 6:
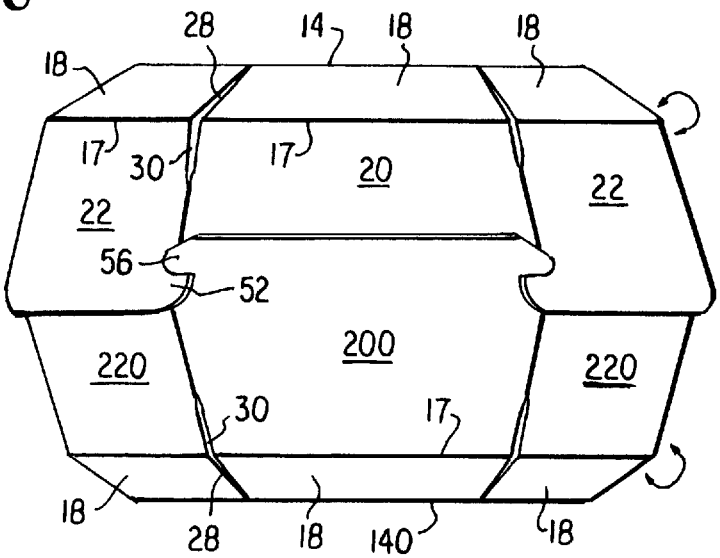
FIG. 6 is a front elevational view of the second embodiment of this invention.
Figure 7:
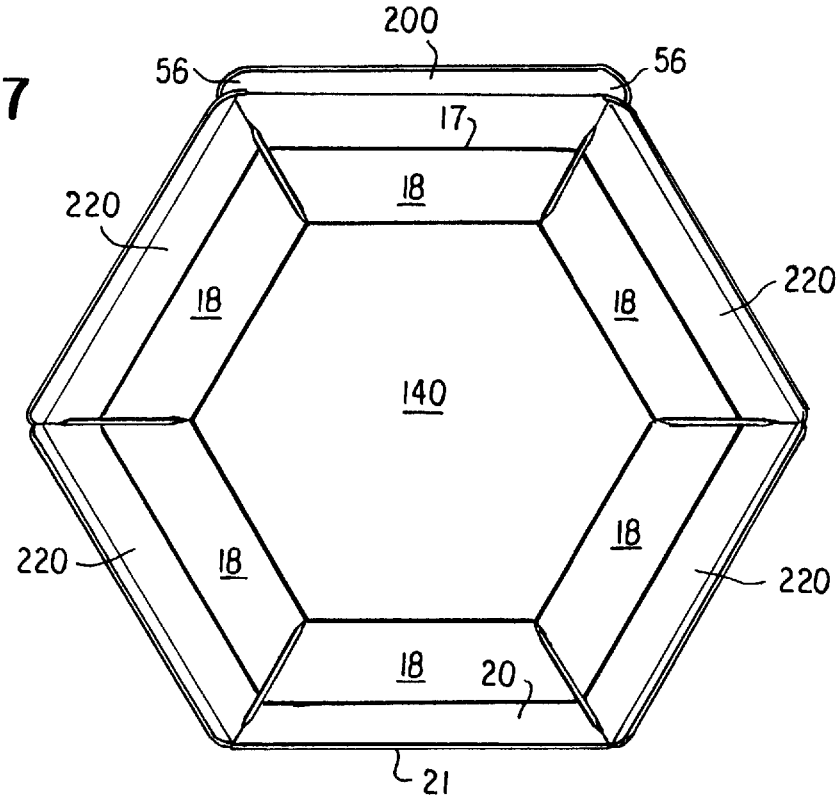
FIG. 7 is a bottom view of the second embodiment of this invention.

Referring now to FIGS. 5, 6, and 7, a second embodiment of the invention is illustrated, here wherein both the tray and the crown are of more or less identical construction. The blank shown at FIG. 5 is similar to the blank at FIG. 1, except that most of the upper or crown forming portion of the blank has been omitted in FIG. 5. Again, a fold line 21 separates the crown from the lower or tray portion of the container. The partially omitted upper portion of the blank is the same as that shown at the upper half of FIG. 1, with the tray of FIG. 5 having a regular hexagonal central bottom panel designated as 140. Sidewall panels 220 are radially shorter, as referred to the center of bottom panel 140, than the corresponding radial dimension of crown sidewall panels 22. Again, the crown and tray sidewalls are adhesively secured together at their respective side edges by foldable glue flaps 24. Lowermost panel 200 of FIG. 5 is similar to lowermost panel 46 of FIG. 1, except that latching tabs 50 of FIG. 1 are denoted as 56 at the lower portion of FIG. 5.

Referring now to FIG. 6, a side elevational view of the clamshell container of the second embodiment is illustrated and shows the lower edges of double sloped crown sidewalls 18, 22 extending beneath the level of the upper portion of tray sidewalls 220. The double slope or angle of both crown and tray sidewalls is indicated by the two double headed arrows. Again, the particular latching arrangement is given for illustrative purposes only and is not necessary for the practice of this invention. Narrow vent portions 28, 30 again serve to permit the escape of warm air, due to the heat from a packaged sandwich within the closed container. FIG. 7 shows a bottom plan view of the second embodiment of the clamshell container of this invention.

In both embodiments, glue tabs 24 may be radially lengthened so as to extend radially inwardly to fold lines 17, thus leaving only portions 30 of the vent spaces. During assembly of the blanks to form the container halves, the overlapping of the cut glue tab ends onto adjacent panels 22 is such that spaces 28, 30 do not completely close, thus producing the vent gaps.

Figure 8:
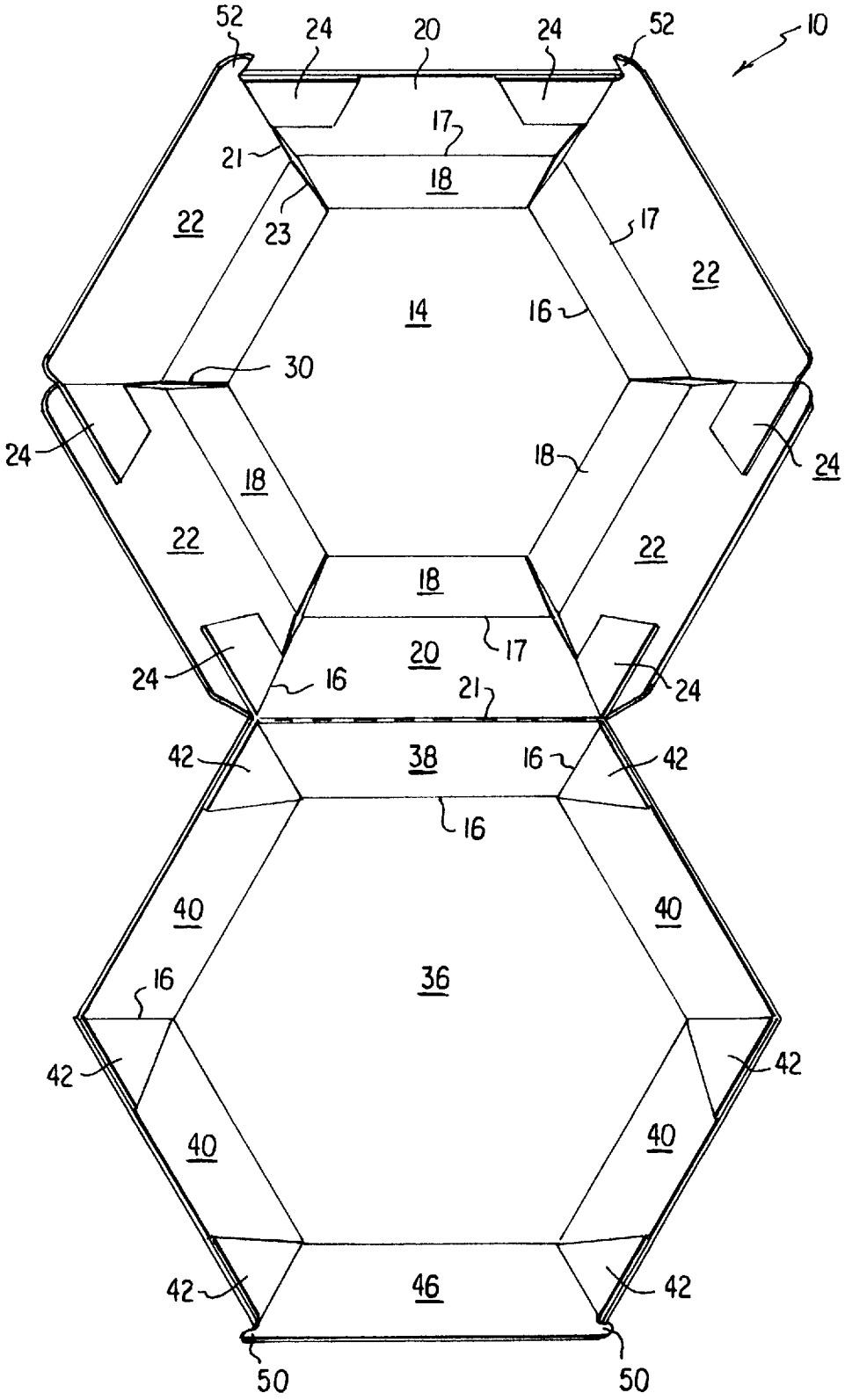
FIG. 8 is a top plan view of the erected and open container of this invention formed from the blank of FIG. 1.

FIG. 8 show the interior of a formed and fully open container formed from the blank of FIG. 1. Glue flaps 24 are shown as adhered in surface to surface contact with adjacent sidewalls 20, 22. This fixes or erects the crown to a dome shape. The next gaps and their opposite edges 21, 23 are clearly seen in the dome or crown interior. Similarly, glue flaps 42 of the tray are seen to be in surface to surface contact with adjacent sidewalls 40.

The general shape of the container crown may be changed by changing the angle, in the blank, between segments 21 and 23 of the vent opening long sides. As shown in the drawings, an angle of about 11 degrees has been found to be satisfactory, but this may be changed if desired.

What is claimed is:

1. A unitary blank of paperboard for forming a clamshell container, said blank including an upper crown half and a lower tray half, said upper crown half including a polygonal central top panel having edges, a plurality of sidewall panels secured to said top panel edges to form a ring of upper sidewall panels, said upper sidewall panels each having at least two foldably connected sections, one of said two sidewall sections being a radially innermost section and the other of said two sidewall sections being a radially outermost section, said upper sidewall panels having foldable glue tabs, circumferentially positioned venting spaces between adjacent said upper sidewall panels, said venting spaces located radially inwardly of and radially aligned with said glue tabs, said lower tray half including a polygonal central bottom panel having edges, a plurality of lower sidewall panels secured to respective said bottom panel edges to form a ring of lower sidewall panels, said lower sidewall panels having foldable glue tabs, said upper and lower blank halves foldably joined together.

2. The blank of claim 1 wherein said circumferentially positioned venting spaces are each in the general form of an isosceles triangle whose two equal sides point radially inwardly toward said central panel, each of said two equal sides having radially innermost and radially outermost segments at an angle to each other, each said radially innermost segment of said two sides defining an end of a respective said radially innermost section of each said sidewall.

3. The blank of claim 1 wherein said upper crown half glue tabs are integrally joined to respective upper half radially outermost upper half sections.

4. A clamshell container having an upper crown half and a lower tray half, said halves being foldably connected together and formed of a unitary blank of paperboard, said upper crown half having a polygonal top central panel top panel having edges, a plurality of upper sidewall panels secured to said central top panel edges to form a ring of upper sidewall panels, said upper sidewall panels each having two foldably connected sections, one of said two sidewall sections being a radially innermost section and the other of said two sidewall sections being a radially outermost section, said two foldably connected sections being at an angle to each other to thereby form an upper crown half whose sidewalls have two different slopes, said upper crown sidewall panels having foldable glue tabs, circumferentially located venting spaces between adjacent said upper sidewall panels, said venting spaces located radially inwardly of and radially aligned with said upper glue tabs, said lower tray half including a polygonal central bottom panel having edges, and a plurality of sidewall panels secured to said bottom panel edges to form a ring of lower sidewall panels.

5. The clamshell container of claim 4 wherein said circumferentially located venting spaces are each in the general form of an isosceles triangle whose two equal sides point radially inwardly toward said top central panel, each of said two equal sides having radially innermost and radially outermost segments at an angle to each other, each said radially innermost segment of said two venting spaces sides defining an end of a respective said radially innermost section of each said sidewall.

6. The clamshell container of claim 4 wherein said upper crown half glue tabs are integrally joined to respective upper half radially outermost upper half sections.

7. A unitary blank of paperboard for forming a clamshell container, said blank including an upper crown half and a lower tray half, said upper crown half including a polygonal central top panel having edges, a plurality of upper sidewall panels secured to said central top panel edges to form a ring of upper sidewall panels, said upper sidewall panels each having two foldably connected sections, one of said two sidewall sections being a radially innermost section and the other of said two sidewall sections being a radially outermost section, said upper sidewall panels having foldable glue tabs, circumferentially located venting spaces between adjacent said upper sidewall panels, said venting spaces located radially inwardly of and radially aligned with said upper glue tabs, said lower tray half including a polygonal central bottom panel having edges, a plurality of sidewall panels secured to said bottom panel edges to form a ring of lower sidewall panels, said lower sidewall panels each having two foldably connected sections, said lower sidewall panels having foldable glue tabs, circumferentially located venting spaces between adjacent said lower sidewall panels, said lower venting spaces located radially inwardly of and radially aligned with said lower glue tabs.

* * * * *